US010045610B2

(12) United States Patent
Pettersson

(10) Patent No.: US 10,045,610 B2
(45) Date of Patent: Aug. 14, 2018

(54) HEIGHT ADJUSTABLE TABLE STAND

(75) Inventor: Hans Pettersson, Habo (SE)

(73) Assignee: KIH-utveckling AB, Jönköping (SE)

( * ) Notice: Subject to any disclaimer, the term of this patent is extended or adjusted under 35 U.S.C. 154(b) by 469 days.

(21) Appl. No.: 13/286,367

(22) Filed: Nov. 1, 2011

(65) Prior Publication Data

US 2012/0126072 A1 May 24, 2012

(30) Foreign Application Priority Data

Nov. 23, 2010 (EP) ..... 10192245

(51) Int. Cl.
*F16M 11/00* (2006.01)
*A47B 9/04* (2006.01)

(52) U.S. Cl.
CPC ..... *A47B 9/04* (2013.01)

(58) Field of Classification Search
USPC ..... 248/188.5; 108/147, 147.19, 188.2, 108/144.11
See application file for complete search history.

(56) References Cited

U.S. PATENT DOCUMENTS 4,635,492 A * 1/1987 Uebelhart ..... 74/89.35
6,682,030 B2 * 1/2004 Santoro et al. ..... 248/188.5
7,098,807 B2 * 8/2006 Seguin et al. ..... 340/907
7,662,035 B1 * 2/2010 Parker et al. ..... 454/228
2010/0064945 A1 3/2010 Sierenberg
2011/0041739 A1 * 2/2011 Verweij ..... 108/147.19

FOREIGN PATENT DOCUMENTS

WO 2007/124754 A2 11/2007
WO 2010/054656 A1 5/2010

OTHER PUBLICATIONS

European Search Report; dated Apr. 20, 2011; Appln. No. EP 10 19 2245.

* cited by examiner

*Primary Examiner* — Amy J. Sterling
(74) *Attorney, Agent, or Firm* — Ladas & Parry LLP

(57) ABSTRACT

The present invention relates to a height-adjustable table stand (1) comprising a height-adjusting arrangement for adjusting the height of the table, wherein the height-adjusting arrangement comprises at least one leg (2), each leg having an inner tubular member (3) and an outer tubular member (4) arranged for telescopic movement relative to each other. The height-adjusting arrangement further comprises a linear actuator coupled to said tubular members (3, 4) and adapted to provide the telescopic movement between the tubular members, an electric motor (12) connected to the linear actuator and adapted to operate the linear actuator for providing telescopic movement between the tubular members, and a control device (13) for controlling the operation of the electric motor (12). The table stand (1) further comprises a solar panel (10) connected to the height-adjusting arrangement for providing power to the electric motor (12).

8 Claims, 5 Drawing Sheets

HEIGHT ADJUSTABLE TABLE STAND

TECHNICAL FIELD

The present disclosure relates to a height-adjustable table stand, and particularly a height-adjustable table stand powered by a solar cell panel.

BACKGROUND

In known height-adjustable table stands, a height-adjusting arrangement is adapted to provide a vertical movement of the table stand by use of an electric motor. In EP2019606 A2, a height-adjustable table is disclosed, comprising an electric motor for providing vertical movement of a linear actuator, and control means for controlling the operation of the electric motor.

The height-adjusting arrangements in known table stands are supplied with electricity from a domestic electricity supply system, i.e. connected to a power socket. When furnishing a room or an office, the location of power sockets must be taken into consideration when placing the table stand. In some occasions, the table stand may not be possible to place at a wanted position due to the location of power sockets.

Consequently, there is a need for a height-adjustable table stand with a height-adjusting arrangement that is independent of power supply from a domestic electricity supply system.

SUMMARY

It is an object of the present invention to provide an improved solution that alleviates the mentioned drawbacks with present devices. Furthermore, it is an object to provide a height-adjustable table stand that can be electrically operated independent of power supply from a domestic electricity supply system.

This is achieved by providing a height-adjustable table stand comprising a height-adjusting arrangement for adjusting the height of the table stand, wherein the height-adjusting arrangement comprises at least one leg, each leg having an inner tubular member and an outer tubular member arranged for telescopic movement relative to each other. The height-adjusting arrangement further comprises a linear actuator coupled to said tubular members and adapted to provide the telescopic movement between the tubular members, an electric motor connected to the linear actuator and adapted to operate the linear actuator for providing telescopic movement between the tubular members, and a control device for controlling the operation of the electric motor. The table stand further comprises a solar panel connected to the height-adjusting arrangement for providing power to the electric motor.

By providing the table stand with a solar panel for powering the electric motor, the table stand may be operated without any connection to a domestic electricity supply system, or to any other power source. When placing the table stand in a room, the placement may not be dependent on the location of power sockets in the room. The solar panel may be connected to the height-adjusting arrangement via a cable. The solar panel may be placed such that it receives sufficient light. The cable may be connected to the electric motor. The cable may be connected to the control device. The control device may provide electric current to the electric motor to control the operation of the electric motor. The control device may control the direction of rotation of the electric motor. The electric motor may be connected to the linear actuator in a leg. The electric motor may be connected to each linear actuator in each leg. When the electric motor is rotated, the linear actuator may be rotated such that it converts the rotational movement to a linear movement. The linear movement of the linear actuator may provide the telescopic movement between the inner and the outer tubular member in the leg. The electric motor may be adapted to be powered by an electric current provided by the solar panel.

In one embodiment, the height-adjusting arrangement may further comprise a battery for storing power generated by the solar panel, and wherein the battery provides power to the electric motor.

By providing a battery between the solar panel and the electric motor, the solar panel may charge the battery during time when the electric motor is not operated. Most of the time, the electric motor is not operated, and thereby the solar panel may charge the battery during a long time before the power stored in the battery is needed for powering the electric motor. A solar panel with less capacity may be used with the height-adjusting arrangement when a battery stores the power generated by the solar panel, than if the solar panel would power the electric motor directly. Further, a stronger electric motor may be used, that needs more electric current than the current generated by the solar panel, when using a battery than if the solar panel would power the electric motor directly. Since the electric motor is used rather rarely and during a short period, the power stored in the battery may be used for other purposes, separate from the height-adjusting arrangement, during the time when the electric motor is not operated.

In another embodiment, the table may further comprise a power providing means connected to the battery for providing power to an additional device, such as a computer.

The additional device may further be other devices such as a lamp, a screen, a charger or the like. During the time when the electric motor is not operated the battery may provide power to an additional device, separate from the height-adjusting arrangement. For instance, the battery may charge a lap top computer during the time when the electric motor is not operated. The battery or the power providing means may be provided with means that controls that the battery does not provide power to an additional device if the power level in the battery is below a predetermined level. The predetermined power level may correspond to a power level needed for powering the electric motor such that the table stand may be raised or lowered. The power providing means may be provided with a switch that may enable or disable the powering of an additional device. The disabling of the powering of an additional device may be performed by the switch as a response to the power level in the battery reaching the predetermined level, or to the electric motor being operated. The enabling of the powering of an additional device may be performed by the switch as a response to the power level in the battery reaching above the predetermined level, or to the operation of the electric motor being terminated. The predetermined level may be two separate predetermined levels for the disabling and the enabling operation by the switch. The power providing means may be located adjacent to the battery. The power providing means may be a box provided with power sockets for connecting of an additional device. The power providing means may further be mounted on top of a table top attached to the table stand.

In one embodiment, a predetermined power level of the battery may be set corresponding to an amount of power needed for a raising or lowering operation of the height-adjusting arrangement, and wherein the power providing means connected to the battery may be adapted to terminate the powering of an additional device when the predetermined power level of the battery is reached.

When an additional device, such as a computer, a lamp, a screen, a charger or the like, is connected to the battery via the power providing means, the power level of the battery may be monitored, such that not all power in the battery is consumed. By setting a predetermined power level, corresponding to the power level needed for operating the height-adjusting arrangement, and terminating the powering of any additional device when that predetermined power level is reached, a scenario wherein the battery contains less power than needed for a height-adjusting operation may be avoided. The power providing means may be adapted to switch the powering of the additional device back on when the battery is charged such that the power level is above the predetermined power level. The powering of the additional device may be switch back on when the battery is charged to a power level that is a specified amount above the predetermined power level.

In a further embodiment, the table may further comprise an induction device powered by the battery.

The induction device may be used for powering a device adapted for induction powering. The induction device may provide a magnetic field such that an electric current is created in the device adapted for induction powering. The device adapted for induction powering may be a battery that is adapted for being charged by induction. The solar panel may then generate power that is used for powering a device adapted for induction powering. The table stand may be provided with a controlling means that control that the powering of the induction device is terminated when the power level in the battery is below a predetermined level. The controlling means may further terminate the powering of the induction device when the electric motor is operated.

In one embodiment, the battery may further comprise means for coupling the battery to a battery charger for charging the battery.

Thereby, the battery may be charged by a battery charger as well as by the solar panel. The power for charging the battery may be provided by a domestic electricity supply system. The battery may thereby temporarily be connected to a domestic electricity supply system for being charged.

In a further embodiment, the solar panel may be mounted on a horizontal surface of the table.

The solar panel may thereby be attached to the table stand at a fixed position. The table stand may be provided with a table top, such that the fixed position of the solar panel may be at a horizontal surface of the table stand such as the table top. The position of the solar panel may be adapted for receiving a sufficient amount of light.

In another embodiment, the solar panel may be moveable relative to the height-adjusting arrangement.

Thereby, the solar panel may be placed at a location that is separated from the table stand. The solar panel may be placed at a location that is optimal for the solar panel to produce electric current. The solar panel may for instance be placed at a window to receive light. The solar panel may be connected to the height-adjusting arrangement via a cable. The solar panel may be provided with fastening means for arranging the solar panel at a location that provides sufficient light. The fastening means may adapt the solar panel to be arranged at a window to receive light.

BRIEF DESCRIPTION OF THE DRAWINGS

The invention will in the following be described in more detail with reference to the enclosed drawings, wherein.

DESCRIPTION OF EMBODIMENTS

Figure 1A:
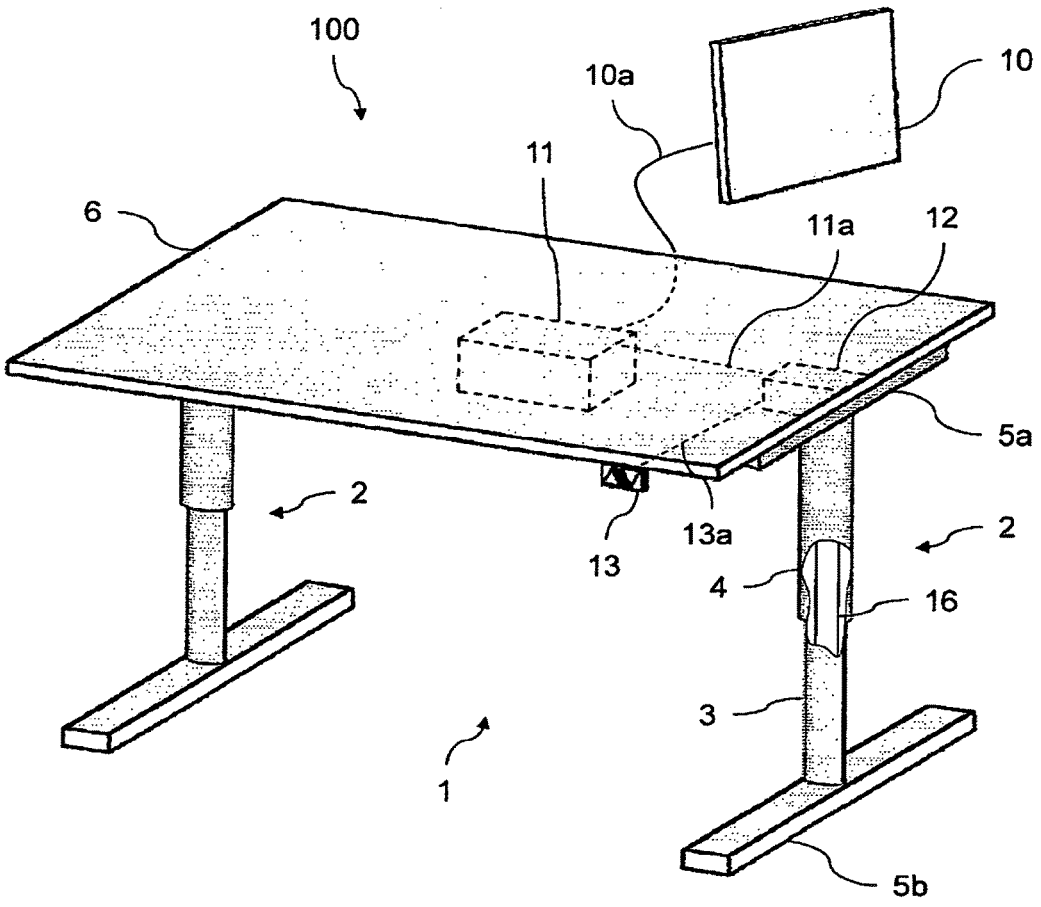
FIG. 1*a* shows a perspective view of a table with a height-adjustable table stand according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

FIG. 1*a* illustrates a height-adjustable table 100 comprising a table top 6 and a table stand 1. The table stand 1 comprises a height-adjusting arrangement. The height-adjusting arrangement comprises two legs 2 each comprising an inner tube 3 and an outer tube 4. The inner and the outer tubes 3, 4 are arranged for telescopic movement relative to each other. Inside the tubes 3, 4, a linear actuator 16 is provided. The linear actuator 16 is in one end attached to the inner tube 3 and in the other end attached to the outer tube 4. The linear actuator 16 provides the telescopic movement between the inner tube 3 and the outer tube 4 when the linear actuator 16 is rotated. The leg 2 further comprises a top part 5*a* and a bottom part 5*b*. The top part 5*a* attaches the leg to the table top 6. The bottom part 5*b* functions as a foot for the table stand 1 when the table 100 stands on a surface.

An electric motor 12 is connected to the linear actuator 16. The electric motor 12 rotates the linear actuator 16 such that a linear telescopic movement of the inner tube 3 and the outer tube 4 is provided. The electric motor 12 is an electric direct current motor preferably adapted for a voltage in the range of 12-40 V.

A control device 13 is provided for control of the operation of the electric motor 12. The control device 13 is mounted underneath the table top 6 for easy access for a user. The control device 13 is connected to the electric motor 12 via a cable 13*a*. The control device 13 is provided with two buttons, one for raising the table and one for lowering the table. The two buttons control the direction of rotation of the electric motor 12, and thereby the direction of rotation of the linear actuator 16. The linear actuator 16 then elongates or retracts depending of the direction of rotation of the electric motor 12.

The electric motor 12 is powered by a battery 11 via a cable 11*a*. The battery 11 is charged by a solar panel 10. The solar panel 10 is connected to the battery 11 via a cable 10*a*. The solar panel 10 is moveable relative to the battery 11, the electric motor 12 and the table top 6. The solar panel 10 may thereby be placed at various locations such as at a window, near a lamp or on the table top 6. The cable 10*a* has a length that provides a mobility of the solar panel 10 to a location separate from the table 100. The length of the cable 10*a* is preferably at least 2 meters. The cable 10*a* is only attached at its end portions. At one end portion, the cable 10*a* is attached to the solar panel 10, and at the other end portion the cable 10*a* is attached to the battery 11.

The battery 11 is mounted on an underside of the table top 6. The battery 11 is connected to the electric motor 12. The battery 11 and the electric motor 12 could be placed in one integrated unit. The battery 11 may be provided with a connector (not shown) for connecting the battery 11 to a battery charger. The battery charger could charge the battery in a similar way as the solar panel 10 charges the battery 11. The battery charger may be connectable to a domestic electricity supply system. The battery 11 may further be provided with means for powering an additional device such as a computer, a lamp, a screen, a phone or the like.

When the electric motor 12 is operated via the control device 13, the powering of an additional device is disconnected. Thereby, all available power in the battery 11 and from the solar panel 10 is available for the electric motor 12.

Further, the power level in the battery 11 is monitored such that a predetermined power level is detected. The predetermined power level corresponds to a power level needed for powering the electric motor 12 during a raising or lowering operation of the height-adjustable table 1. When the predetermined power level in the battery 11 is detected, the powering of any additional device is terminated. Thereby, there will always be a sufficient amount of power in the battery 11 even when the battery 11 also powers other devices than the electric motor 12. When the battery 11 is charged by the solar panel 10 or a battery charger, such that the power level in the battery is above the predetermined power level, the powering of the additional device is switched back on.

Figure 1B:
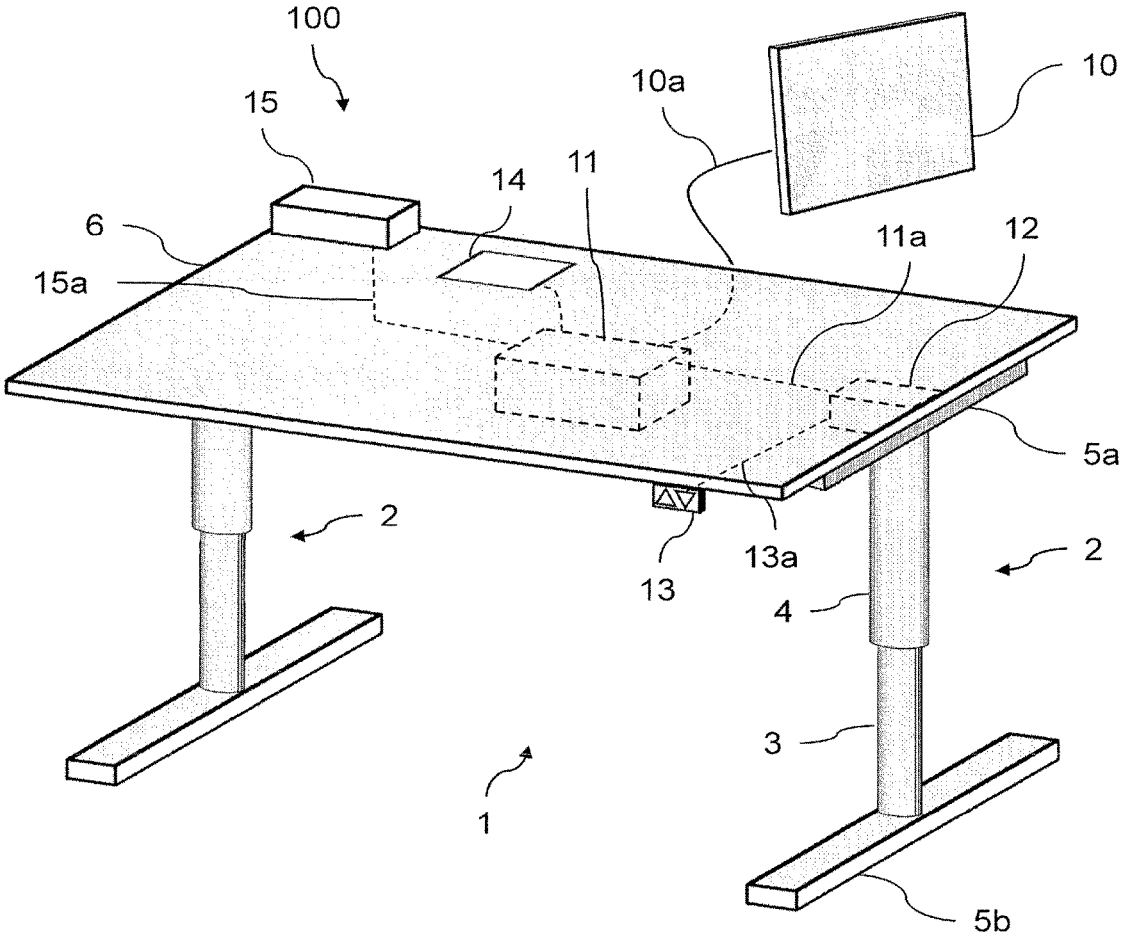
FIG. 1*b* shows a perspective view of a table with a height-adjustable table stand according to another embodiment of the invention.

FIG. 1*b* illustrates a height-adjustable table 100 similar as in FIG. 1*a*, wherein the table stand 1 is provided with an induction device 14. The induction device 14 is mounted on the table top 6 and connected to the battery 11. The induction device 14 is powered by the battery 11. The induction device 14 is used for powering a device adapted for induction powering. Such device adapted for induction powering may be a battery in an electric device such as a phone, a computer or the like.

When the electric motor 12 is operated via the control device 13, the powering of an additional device and/or the induction device is disconnected. Thereby, all available power in the battery 11 and from the solar panel 10 is available for the electric motor 12.

When the predetermined power level in the battery 11 is detected, the powering of the induction device 14 and/or any other additional device is terminated. Thereby, there will always be a sufficient amount of power in the battery 11 even when the battery 11 also powers other devices than the electric motor 12. When the battery 11 is charged by the solar panel 10 or a battery charger, such that the power level in the battery is above the predetermined power level, the powering of the additional device and/or the induction device is switch back on.

The table stand 1 further comprises a power providing means 15 connected to the battery 11 via a cable 15*a*. The power providing means 15 is mounted on top of the table top 6. The power providing means may be provided with power sockets or other connecting means for connecting an additional device adapted to be powered via the power providing means 15. The power providing means 15 controls the powering of any additional device connected to the power providing means 15. The power providing means could also control the powering of the induction device 14. The power providing means 15 comprises a switch that enables or disables the powering of an additional device. The enabling and disabling of the powering of an additional device is performed as a response to the power level in the battery 11 reaching a predetermined level, or to that the electric motor 12 is operated. In one embodiment, the switch disables the powering of an additional device when the battery level reaches below a first predetermined level. Further, the switch enables the powering of an additional device when the battery level reaches above a second predetermined level, wherein the second predetermined level is higher than the first predetermined level.

Figure 1C:
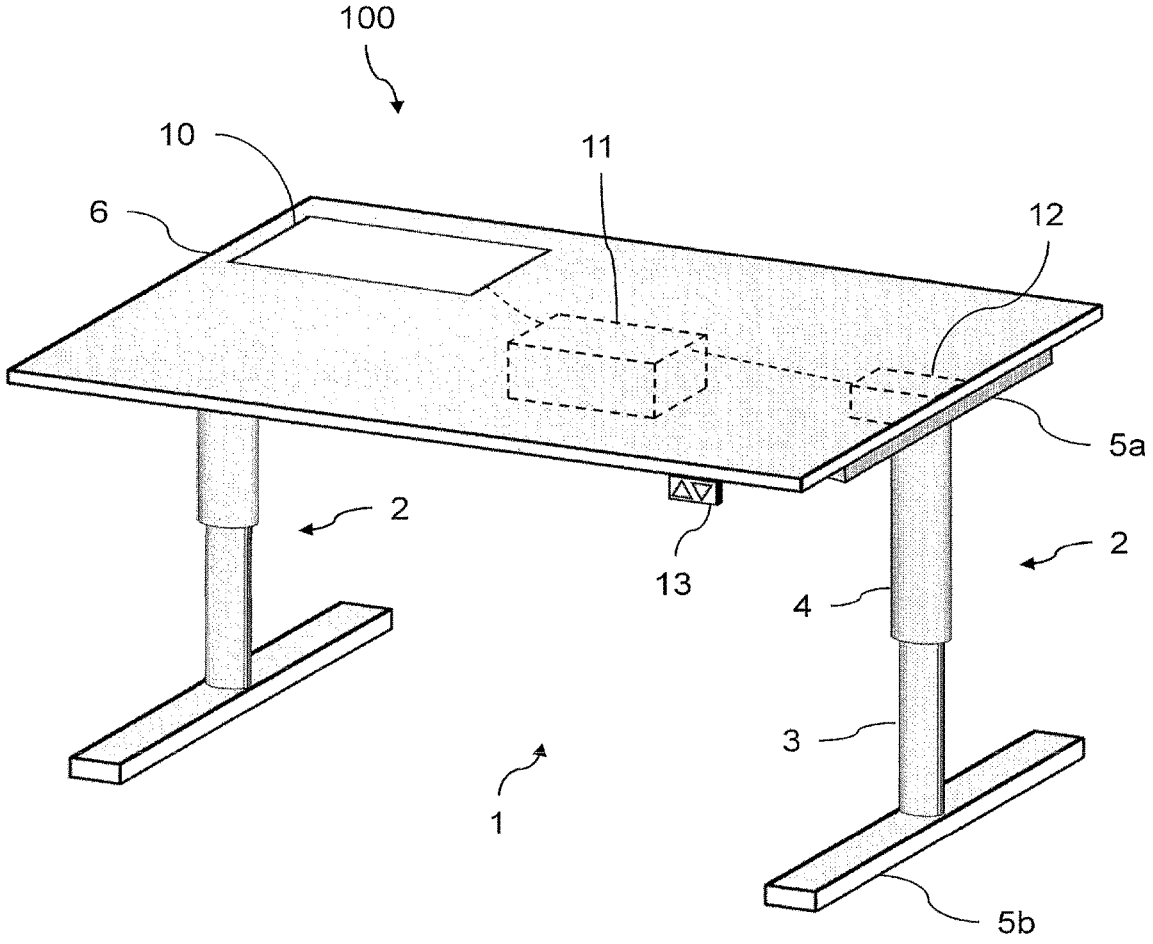
FIG. 1*c* shows a perspective view of a table with a height-adjustable table stand according to yet another embodiment of the invention.

FIG. 1*c* illustrates a height-adjustable table 100 similar as in FIG. 1*a*, but wherein the solar panel 10 is mounted on the table top 6. The solar panel 10 mounted on the table top 6 is connected to the battery 11 via a cable.

Figure 2A:
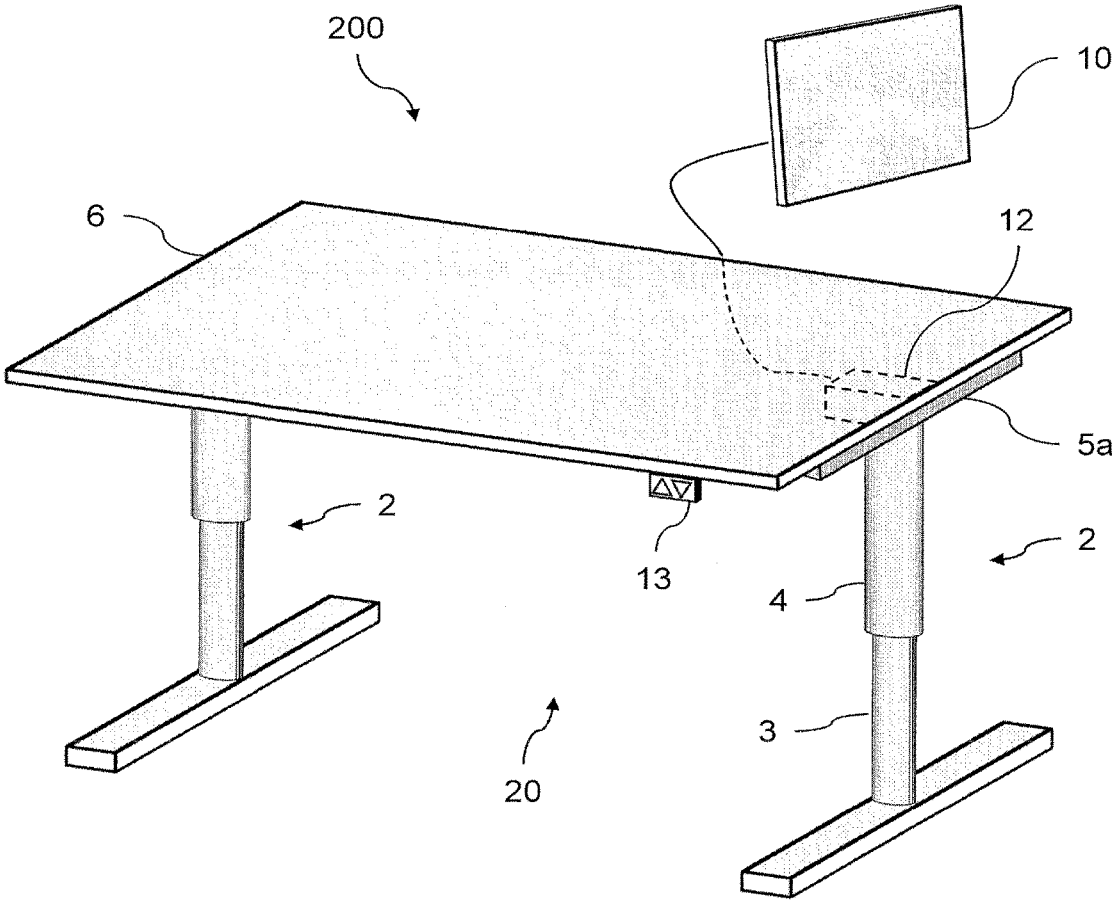
FIG. 2*a* shows a perspective view of a table with a height-adjustable table stand according to another embodiment of the invention.

FIG. 2*a* illustrates a height-adjustable table 200 comprising a table top 6 and a height-adjustable table stand 20 with a height-adjusting arrangement comprising two legs 2, an electric motor 12 and a solar panel 10. The solar panel 10 is connected directly to the electric motor 12 via a cable. The solar panel 10 is moveable relative to the electric motor 12 and the table top 6. The solar panel 10 may be placed at various locations to receive light for producing electric current to the electric motor 12. The electric motor 12 is operated by the control device 13. When a button on the control device 13 is pressed, the electric motor 12 rotates the linear actuator in a leg 2. The electric current for the operation of the electric motor 12 is produced by the solar panel 10.

Figure 2B:
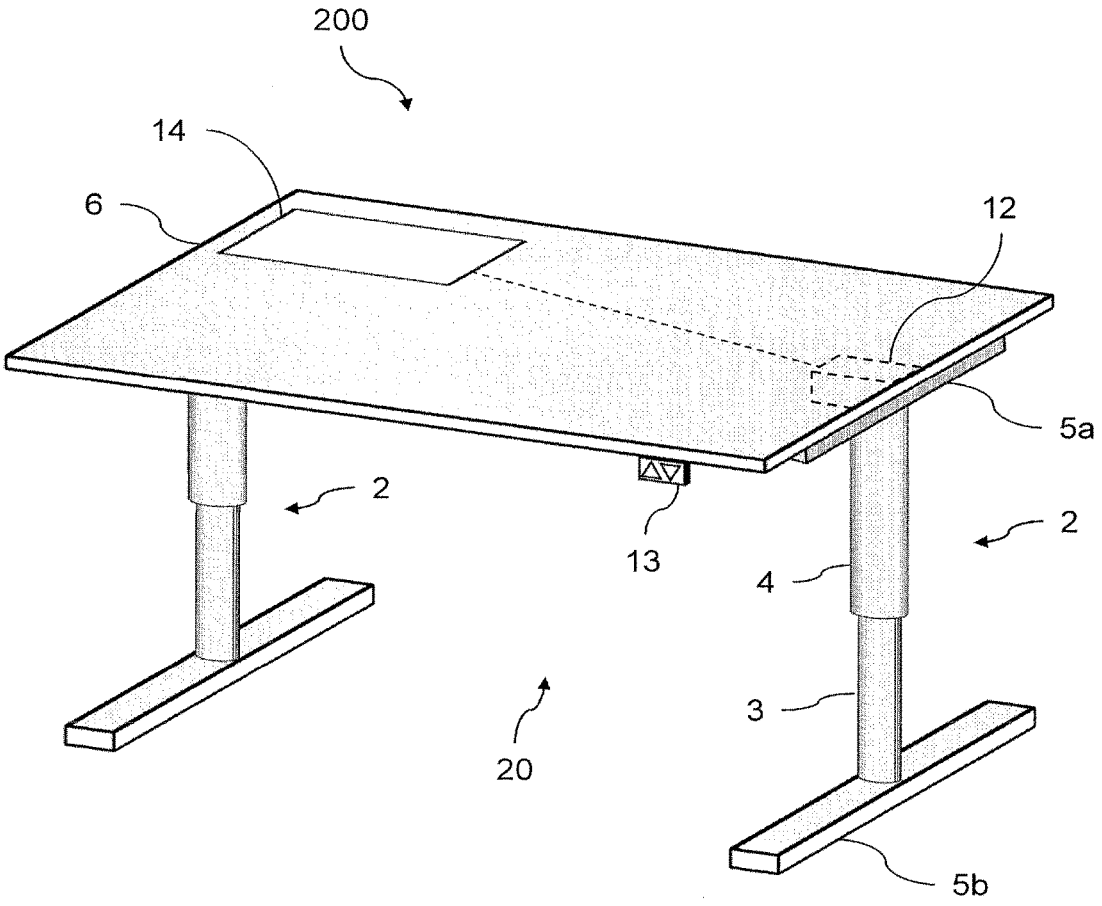
FIG. 2*b* shows a perspective view of a table with a height-adjustable table stand according to yet another embodiment of the invention.

FIG. 2*b* illustrates a height-adjustable table 200 similar as in FIG. 2*a*, but wherein the solar panel 10 is mounted on the table top 6. The solar panel 10 mounted on the table top 6 is connected to the electric motor 12 via a cable.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A height-adjustable table stand comprising:

a height-adjusting arrangement for adjusting the height of the table stand, wherein the height-adjusting arrangement comprises, at least one leg, each leg having an inner tubular member and an outer tubular member arranged for telescopic movement relative to each other, wherein one of the tubular members is a stationary tubular member and the other tubular member is a vertically moveable tubular member, and a linear actuator attached to said tubular members and adapted to provide the telescopic movement between the tubular members;

a motor connected to the linear actuator;

a control device connected to a table top and coupled to the motor, wherein the table stand further comprises a solar panel connected to the motor; and a battery between the solar panel and the motor, wherein the solar panel is moveable relative to a battery, the motor, and the table top of the table stand; and wherein the solar panel is placed at a window.

2. A height-adjustable table stand comprising:

at least one leg comprising an inner tube and an outer tube;

a linear activator attached to the inner and outer tubes;

a table top attached to the leg;

a motor attached to the table top;

a battery attached to the table top and coupled to the motor;

a control device attached to the table top and coupled to the motor;

a solar panel connected to the battery, wherein the solar panel is moveable relative to the battery, the motor, and the table top; and a cable connecting the solar panel to the battery;

wherein the inner and outer tubes of the leg are arranged for telescopic movement relative to each other;

wherein the battery is connected underneath the table top;

wherein one end of the linear actuator is attached to the inner tube of the leg and another end of the linear actuator is attached to the outer tube of the leg; and wherein the motor is configured to rotate the linear actuator such that a linear telescopic movement of the inner and outer tubes of the leg is provided.

3. The height-adjustable table stand of claim 2, further comprising:

a bottom part attached to the leg; and a top part attached to the leg and attached to the table top.

4. The height-adjustable table stand of claim 2, wherein the cable is at least 2 meters in length.

5. The height-adjustable table stand of claim 2, wherein the motor is an electric direct current motor configured for a voltage in a range of between 12-40 V.

6. The height-adjustable table stand of claim 2, wherein the linear actuator is configured to elongate and to retract depending on a direction of rotation of the motor.

7. The height-adjustable table stand of claim 2, wherein the height-adjustable table stand comprises two legs attached to the table top.

8. The height-adjustable table stand of claim 1, wherein the solar panel further comprises an adaptable window fastening means.

* * * * *